United States Patent [19]

Smith

[11] Patent Number: 4,530,744

[45] Date of Patent: Jul. 23, 1985

[54] METHOD AND APPARATUS FOR THE PRODUCING OF LIQUID HYDROGEN

[76] Inventor: Eric M. Smith, 26 Eastcliffe Ave., Kenton Park, Newcastle-upon-Tyne, NE3 4SN, England

[21] Appl. No.: 588,110

[22] Filed: Mar. 9, 1984

[30] Foreign Application Priority Data

Mar. 10, 1983 [GB] United Kingdom ..... 8306590
May 16, 1983 [GB] United Kingdom ..... 8313436

[51] Int. Cl.[3] ..... C25B 1/04; C25B 9/00

[52] U.S. Cl. ..... 204/129; 204/262; 204/265; 204/266; 62/332; 62/335

[58] Field of Search ..... 204/129, 262, 274, 266, 204/265; 62/332, 335

[56] References Cited

U.S. PATENT DOCUMENTS 2,922,285 1/1960 Rae ..... 204/129
4,048,814 9/1977 Quach ..... 62/335
4,107,277 8/1978 Rosa ..... 204/129

*Primary Examiner*—R. L. Andrews

*Attorney, Agent, or Firm*—Cushman, Darby & Cushman

[57] ABSTRACT

A method and apparatus for producing liquid hydrogen in which water is electrolyzed under pressure to generate separate streams of oxygen and hydrogen. A buffer cooling circuit is provided between two streams in order that heat can be removed safely from the hydrogen product stream by direct or indirect heat exchange with an inert medium flowing in the cooling circuit. At least some of cooling and/or work required in the cooling circuit is provided by expanding the oxygen stream. Preferably, heat is exchanged between at least some of the inert medium and the low pressure oxygen stream. The invention requires only compression of the feed water so avoiding the work necessary in prior art processes to comprise feed hydrogen gas. Also, use of the high pressure oxygen to provide work and or cooling required elsewhere in the plant. As compared with conventional liquefaction processes, the economies are sufficient to enable the production, on a commercial scale, of liquid hydrogen for use as aircraft fuel to replace the usual fossil based fuels.

17 Claims, 10 Drawing Figures

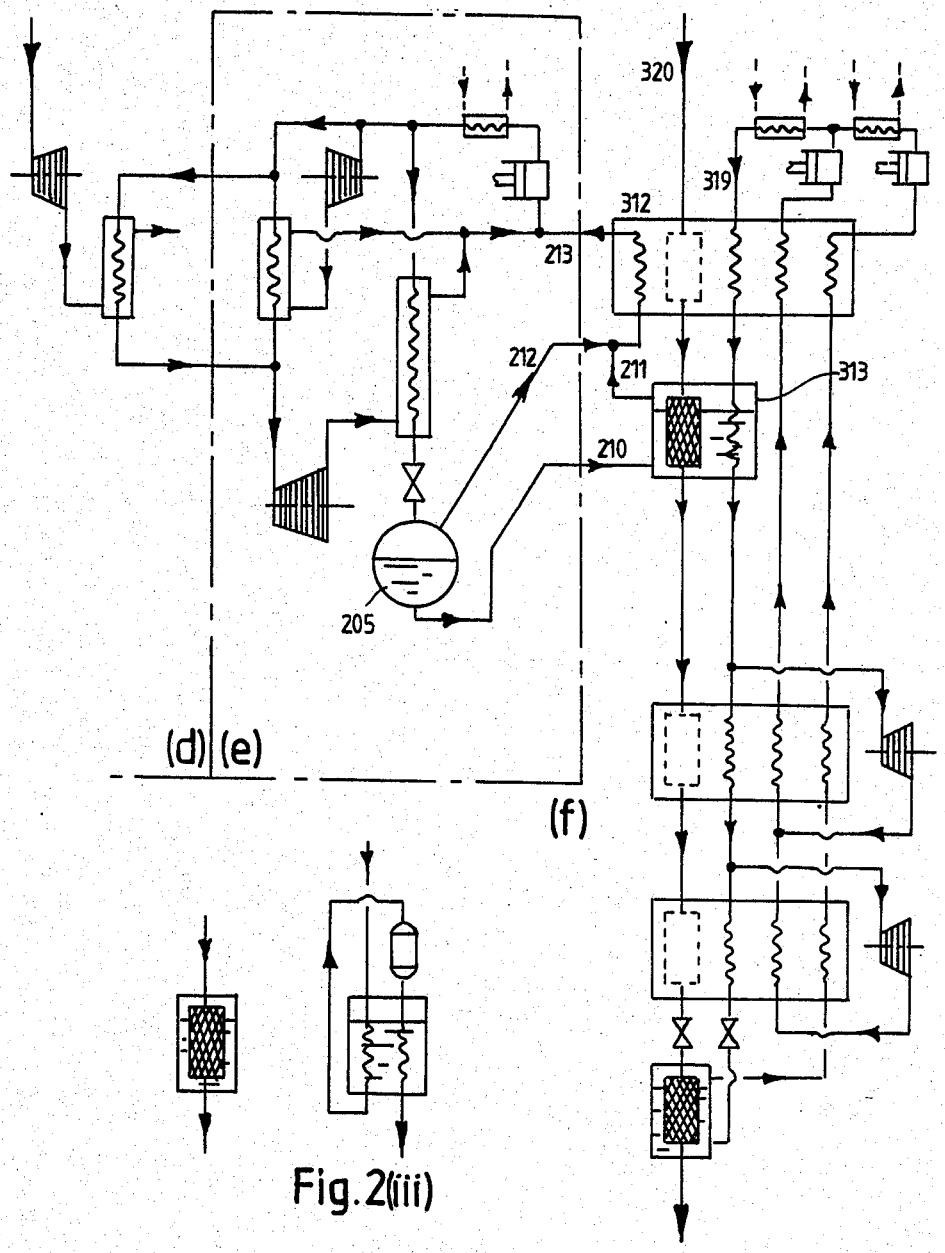
Fig. 2(iii)

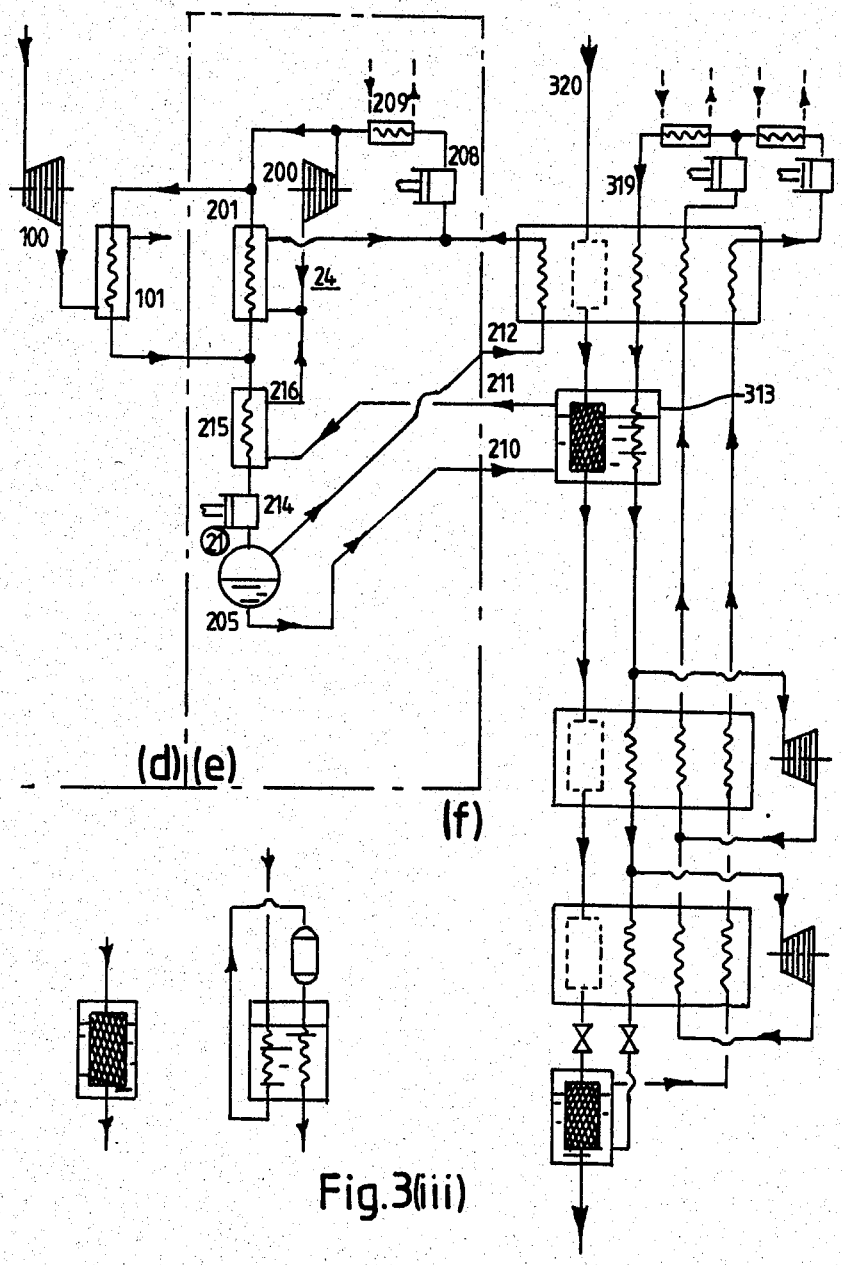
Fig.3(iii)

METHOD AND APPARATUS FOR THE PRODUCING OF LIQUID HYDROGEN

This invention relates to a method of and apparatus for the production of liquid hydrogen.

Arising from the recognition that stocks of fossil fuels are rapidly depleting much research has, in recent years, been directed to the search for alternative sources of fuels and raw material. Hydrogen is now seen as an important secondary or convenience fuel, as a means of distributing power generated by nuclear or hydropower souces in small packages for transport and power generation, as a desirable feedstock in the conversion of solid fossil fuels into synthetic gaseous and liquid fuels, and as a major feedstock for the ammonia fertilizer industry.

The use of liquid hydrogen as a fuel particularly for jet aircraft, has a number of environmental and technological advantages over conventional fuels and liquefaction plants capable of operating on a commercial scale have been developed. At present levels, however, a cost comparison with existing fuels is unfavourable particularly when the source of hydrogen is electrolysis, which is accepted as the most likely source for providing the vast volumes required were hydrogen to become universally accepted as the fuel to replace conventional fossil based fuel.

It is recognised that a key problem in the development of hydrogen technology is the energy cost of liquefaction of hydrogen. In a paper entitled "A study of the efficiency of hydrogen liquefaction", C. R. Baker and R. L. Shaner (Int. J. Hydrogen Energy 1978, vol. 3 pp. 321–334) a typical liquefaction plant is described having three distinct process streams, a liquid hydrogen product stream, a hydrogen recycle stream and a cold nitrogen stream of which the nitrogen stream supplied partly as liquid and partly as cold gas, and the hydrogen recycle stream provides the refrigeration needed for liquefaction of the product stream. This paper points to the hydrogen compressor efficiency and nitrogen refrigerator efficiency as the two areas affording the greatest opportunity for improving the process efficiency although it was then thought that improvements will be both marginal and difficult to achieve.

One object of the present invention is to gain improvement in the efficiency of liquefaction of hydrogen by other means.

What I propose in accordance with the present invention is to perform electrolysis of water under pressure as is known per se, so providing a hydrogen product stream and an oxygen stream under pressure and to use the oxygen pressure stream by-product of electrolysis to provide work and/or cooling for the liquefaction of the hydrogen product stream.

According to one aspect of the present invention, I propose a method of producing liquid hydrogen comprising electrolysing water under pressure to generate separate streams of oxygen and hydrogen gas under pressure, removing heat from the hydrogen stream during liquefaction thereof by heat exchange optionally via an intermediate heat exchange stage, with an inert medium flowing in a separate cooling circuit, and expanding the oxygen stream to produce work and/or cooling for the inert medium cooling circuit.

According to another aspect of the present invention, I propose apparatus for the production of liquid hydrogen and the like in which, during liquefaction of the hydrogen product stream, heat is removed therefrom by heat exchange optionally via an intermediate heat exchange stage, with an inert medium flowing in a separate cooling circuit, and comprising apparatus for the electrolysis of water under pressure to produce the hydrogen product stream and an oxygen stream both under pressure, and expansion means connected to the oxygen stream and supplying low pressure oxygen to a heat exchanger in the cooling circuit for the inert medium.

In a preferred embodiment, the apparatus comprises a hydrogen liquefaction module receiving a stream of hydrogen under pressure from the electrolysis means, an oxygen module receiving a stream of oxygen under pressure from the electrolysis means and including the said expansion means, and a buffer cooling circuit connected between the hydrogen liquefaction module and the oxygen module and comprising a closed circuit refrigeration system for an inert medium including a heat exchanger in which the inert cooling medium is cooled against low pressure oxygen received from the expansion means, the hydrogen liquefaction module including a first heat exchanger in which the hydrogen product stream is cooled against the inert medium flowing in the cooling circuit.

Heat is also removed from the hydrogen product stream at temperatures below the temperature at which heat exchange occurs with the inert medium cooling circuit, to produce liquified hydrogen. This may be by heat exchange first with gaseous hydrogen and later with liquified hydrogen in a hydrogen refrigeration system, preferably an open cycle refrigeration system. Alternatively, such low temperature heat exchange may be with hydrogen or helium, preferably gaseous helium, in a closed cycle refrigeration system or by magnetic cooling as described in "Can Magnetic refrigerators liquefy hydrogen at high Efficiency": J. A. Barclay: ASME paper 81-HT-82, 20th Joint ASME/AIChE National Heat Transfer Conference, August 1981.

Other than hydrogen, helium is the only fluid suitable for refrigerating liquified hydrogen at the lowest temperature (during conversion from ortho- to para-hydrogen). Hence the operating pressure at the lowest temperature level (approx 20° K.) need not be sub-atmospheric, which is advantageous having regard to the amount of recycle compression work required in a closed cycle helium refrigeration system.

In this specification, the terms "high pressure" and "low pressure" used in relation to the gases, nitrogen and hydrogen are intended to means any pressure above and below the critical pressure for each gas respectively. Typical high pressure may be between the critical pressure for hydrogen (say 13 bar) to 250 bar and up to 100 bar for nitrogen. Typical high pressure for oxygen corresponds approximately to the electrolysis pressure for hydrogen, say 45 bar. "Low pressure" implies pressure between bottom end of "high pressure" range and zero.

"Open cycle" hydrogen refrigeration system refers to an arrangement in which the hydrogen liquefaction stream may mix with the recycle hydrogen refrigeration stream at one or more points. A "closed cycle" refrigeration system is not so connected to the hydrogen liquefaction system.

By performing electrolysis of water under pressure it is required only to compress to feed water so avoiding the work necessary in the prior art processes and apparatus to compress a supply of gaseous hydrogen prior to liquefaction. Further economies arise by using expansion of near ambient temperature oxygen gas from high pressure to atmospheric pressure in, for example, expansion engines, which may have inert gas bearings, and/or expansion throttles to produce work and/or cooling required by the rest of the plant.

To optimise the conditions within the inert medium cooling circuit, it is possible to adjust the temperature level at which heat exchange with the low pressure oxygen stream takes place. For example, auxiliary refrigeration may be introduced in the oxygen stream upstream of the oxygen expansion engine or equally in the inert medium cooling circuit.

The inert medium cooling circuit, also acts as a buffer between the oxygen and hydrogen streams so enabling heat to be transported from one stream to the other without the risk of explosion due to leakage of hydrogen into the oxygem stream or vice versa. It is in any event, preferred to isolate the hydrogen liquefaction stream and the hydrogen refrigeration streams from the inert medium circuit by fitting hydrogen detectors or filters therebetween. These may be in the form of couplings in the inert medium circuit incorporating metal hydride absorbers.

Suitable inert media for the buffer system or cooling circuit include helium, argon, neon and nitrogen. In the preferred embodiment the inert medium is nitrogen and the cooling circuit is preferably a closed circuit nitrogen liquefaction system.

In a preferred embodiment, the nitrogen cooling circuit or buffer module receives cooling from the oxygen stream by means of an ($O_2/N_2$) heat exchanger, and the nitrogen module preferably incorporates further cooling means such as an expansion machine and/or expansion throttle and/or reversed Stirling-cycle refrigeration system downstream of the said ($O_2/N_2$) heat exchanger.

Additionally the said ($O_2/N_2$) heat exchanger may be connected in parallel with a second ($N_2/N_2$) heat exchanger, the cold nitrogen outflow from the two exchangers being combined upstream of the further cooling means.

The further cooled nitrogen so produced may itself be wholly or partly liquefied or alternatively used in counterflow heat exchange against another high pressure nitrogen stream being cooled before expansion and partial liquefaction.

Where high pressure nitrogen is required for expansion cooling in the nitrogen circuit, gas compressors followed by heat rejection to ambient temperature are preferred, otherwise low-head circulating pumps may be employed.

Other features of the present invention are set forth in the appendant claims.

Various embodiments of the invention will now be described by way of example with reference to the accompanying drawings in which:

BRIEF DESCRIPTION OF THE DRAWINGS

FIG. 2(iii) is a diagram similar to FIG. 2(i) but with a different nitrogen liquefaction module e, and a different hydrogen liquefaction module f;

FIG. 2(iv) is a diagram similar to FIG. 2(i) but with a different nitrogen liquefaction module e, and a different hydrogen liquefaction module f;

FIG. 3(iii) is a diagram similar to FIG. 3(i) but with a different nitrogen liquefaction module e, and a different hydrogen liquefaction module f;

FIG. 3(iv) is a diagram similar to FIG. 3(i) but with a different nitrogen liquefaction module e and a different hydrogen liquefaction module f.

DETAILED DESCRIPTION OF THE DRAWINGS

Figure 1:
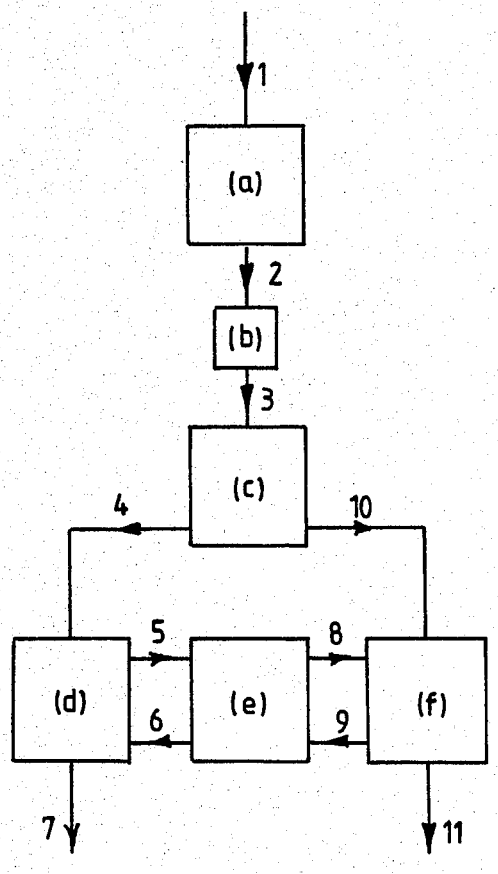
FIG. 1 is a block diagram of one embodiment of plant for the production of liquid hydrogen.

Referring first of all to FIG. 1: feed water 1 at neat ambient pressure and temperature is passed through a water filtration, deionisation and degassing module a which is connected at 2 to the inlet of a high pressure feed pump b delivering at its outlet 3 water under pressure (typically 45 bar) to a water electrolysis module c. Oxygen and hydrogen gas are generated by electrolysis at high pressure, are cooled to near ambient temperature, and dried and have trace impurities removed in module c and then pass respectively along lines 4 and 10 to an oxygen module d and a hydrogen liquefaction module f.

Module e, which is connected to both the oxygen module d and the module f producing liquid hydrogen for storage, is a closed cycle nitrogen module which provides to the hydrogen module f liquid and/or gaseous nitrogen 8 at cryogenic temperature for cooling the hydrogen product and/or hydrogen refrigeration streams. Within the oxygen module d the high pressure oxygen gas is expanded to and discharged to atmosphere at near ambient pressure but not necessarily to waste. So providing power for use by the rest of the plant, and/or some of the cooling for the nitrogen 9 returning from the hydrogen module f at low pressure. Nitrogen 6 enters the oxygen module at high pressure and near ambient temperatures and is returned 5 at high pressure and cryogenic temperatures.

The nitrogen module additionally serves as a buffer to keep the oxygen and hydrogen streams apart and may incorporate means for detecting the presence, due to leakage, of hydrogen and/or oxygen. Hydrogen filters for example, incorporating so-called metal hydride adsorbers may be included in the couplings between the hydrogen f and nitrogen e modules.

Figure 2I:
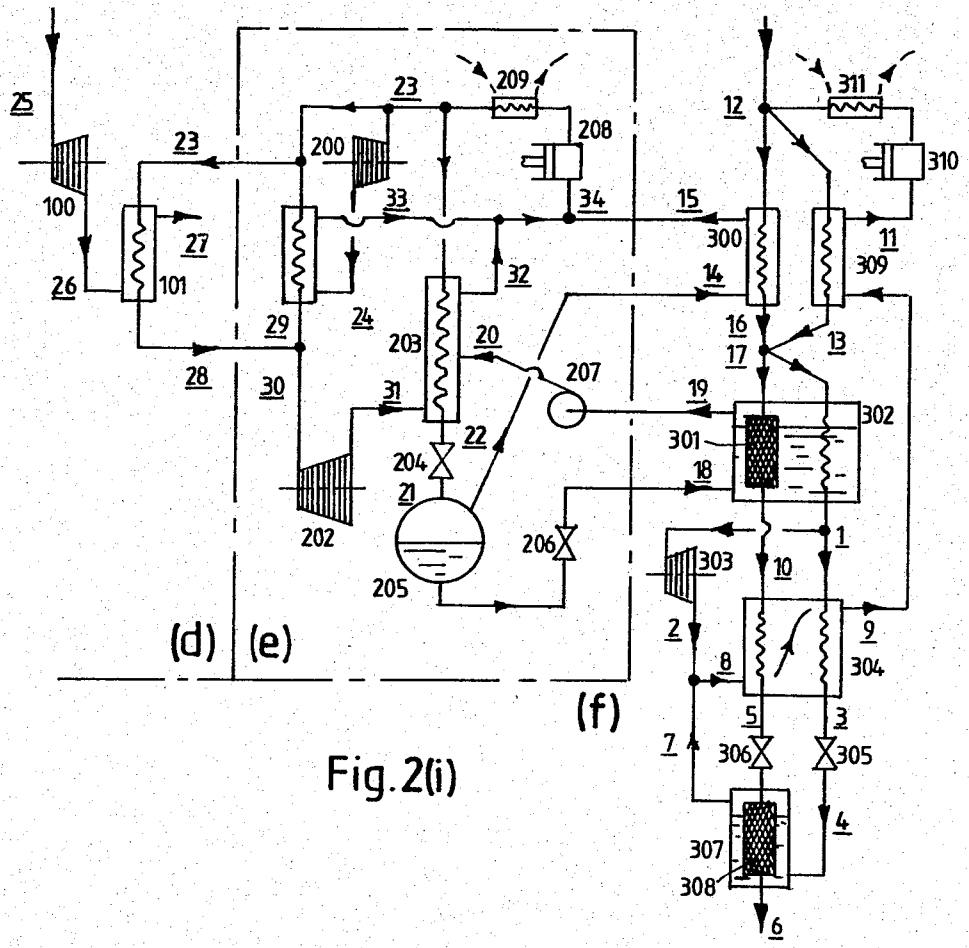
FIG. 2(i) is a diagram showing details of the modules d, e and f in the embodiment of FIG. 1.
Figure 2:
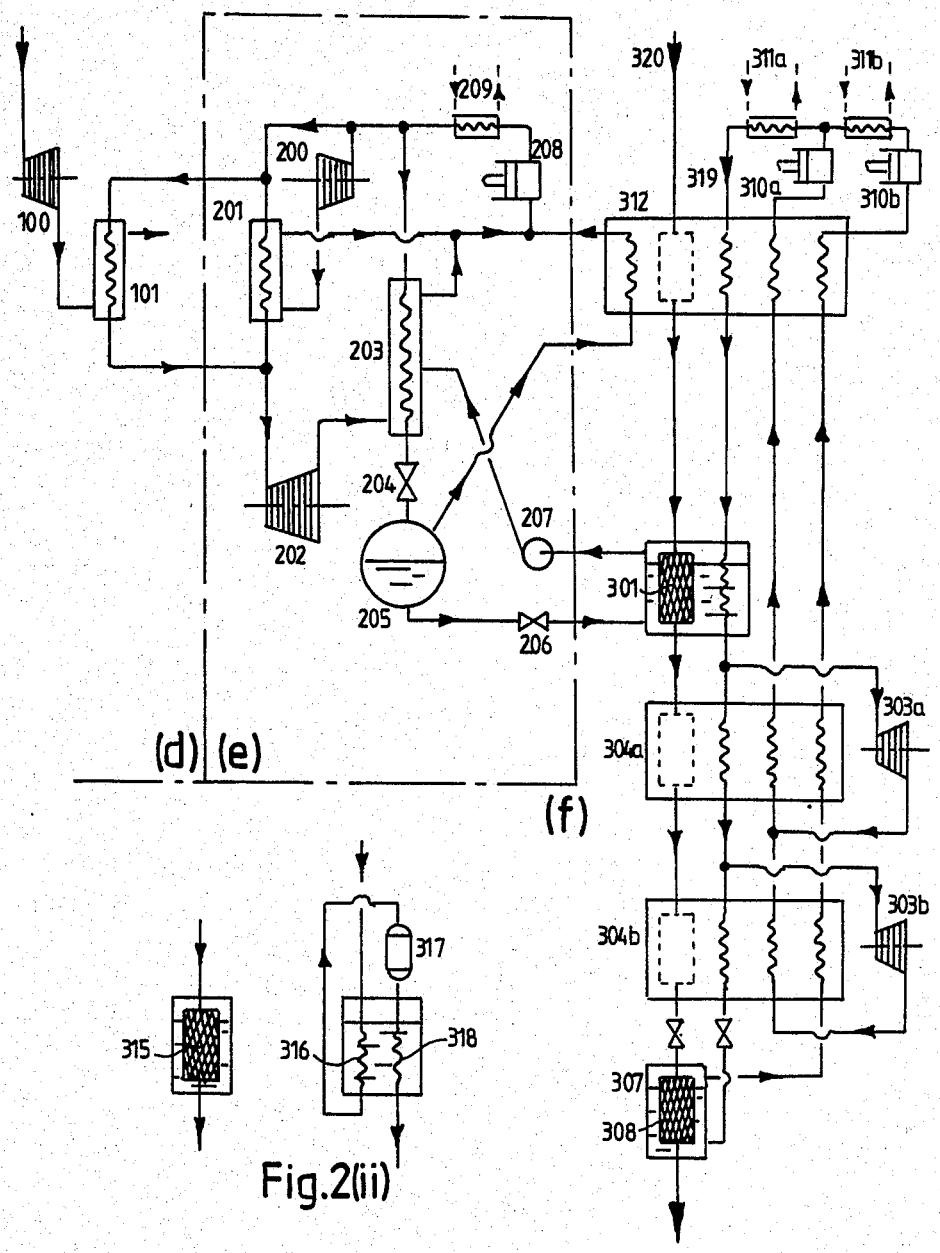
FIG. 2(ii) is a diagram similar to FIG. 2(i) but with a different hydrogen liquefaction module f.
Figure 2:
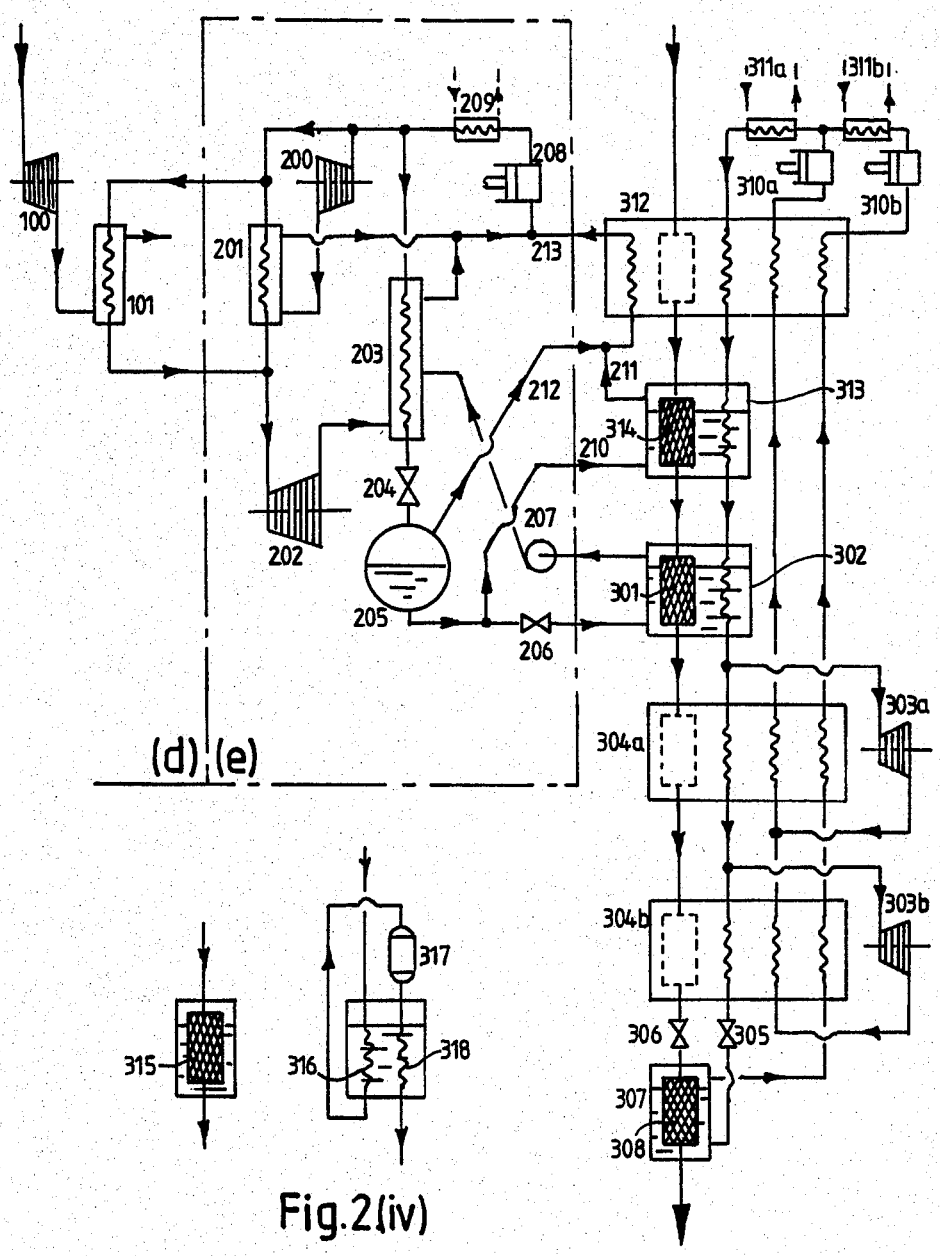
Figure 3I:
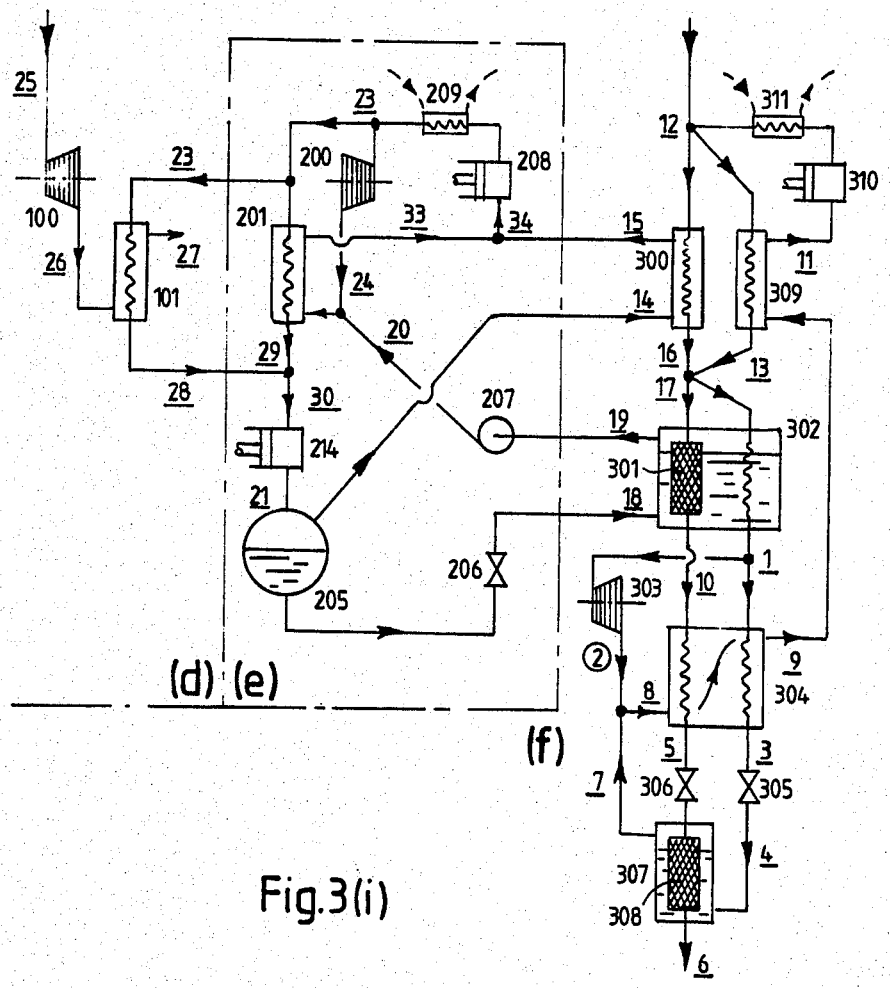
FIG. 3(i) is a diagram showing details of another arrangement of the modules, d, e and f in the embodiment of FIG. 1.
Figure 3:
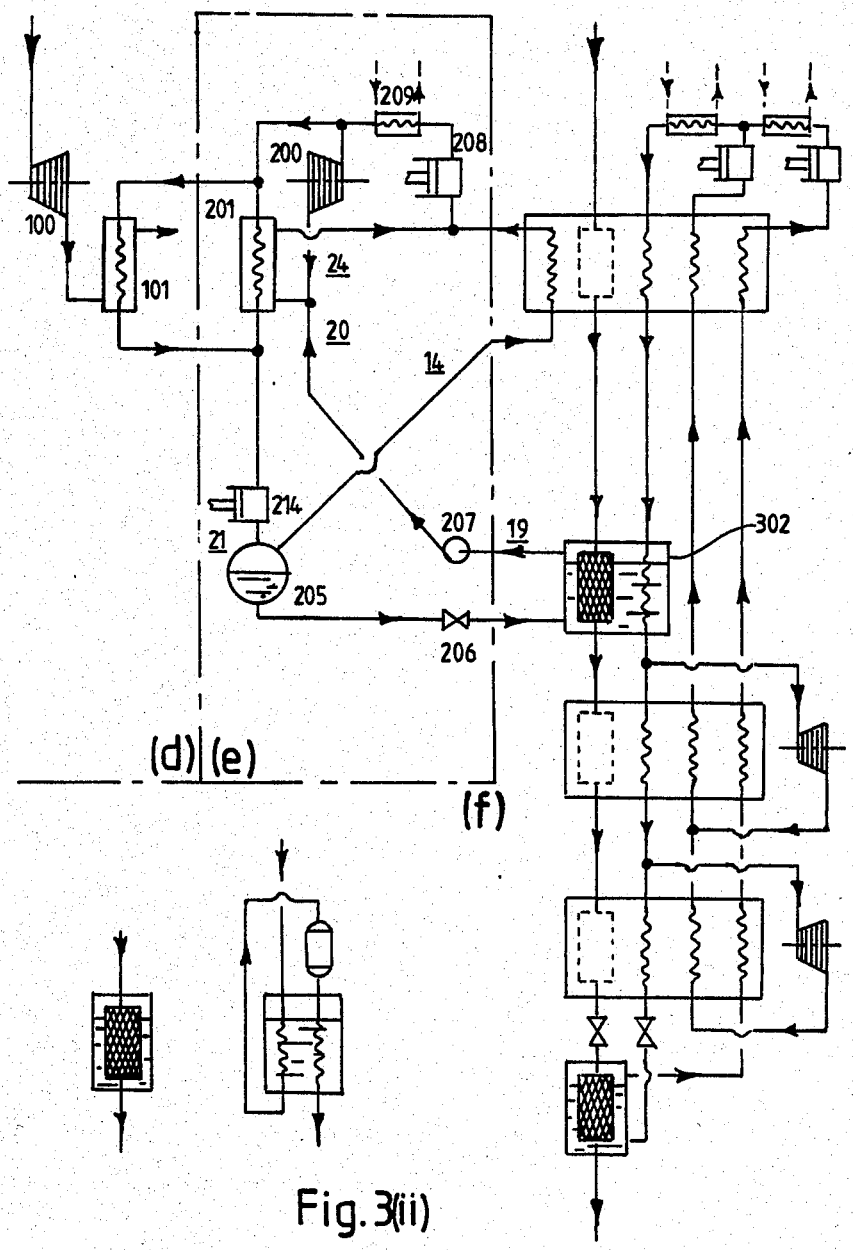
FIG. 3(ii) is a diagram similar to FIG. 3(i) but with a different hydrogen liquefaction module f.
Figure 3:
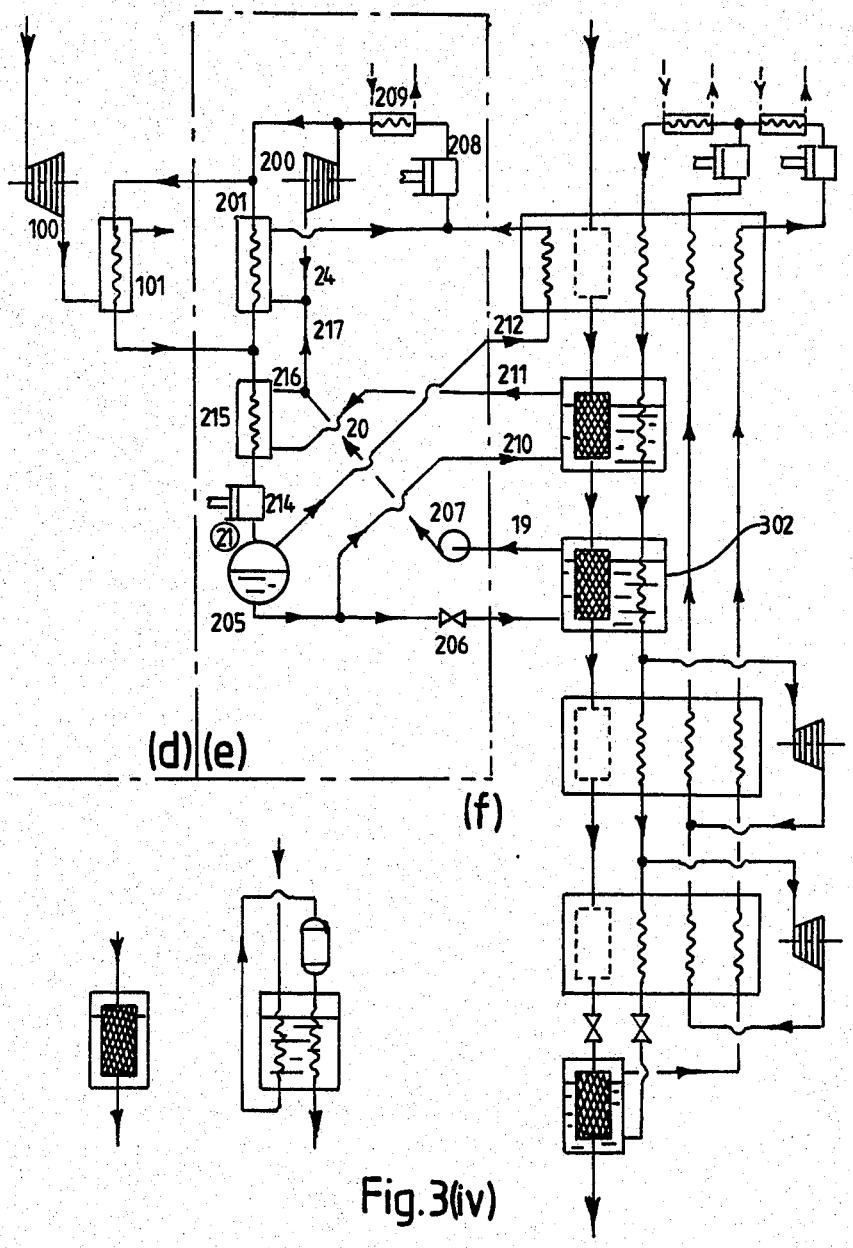
Figure 4:
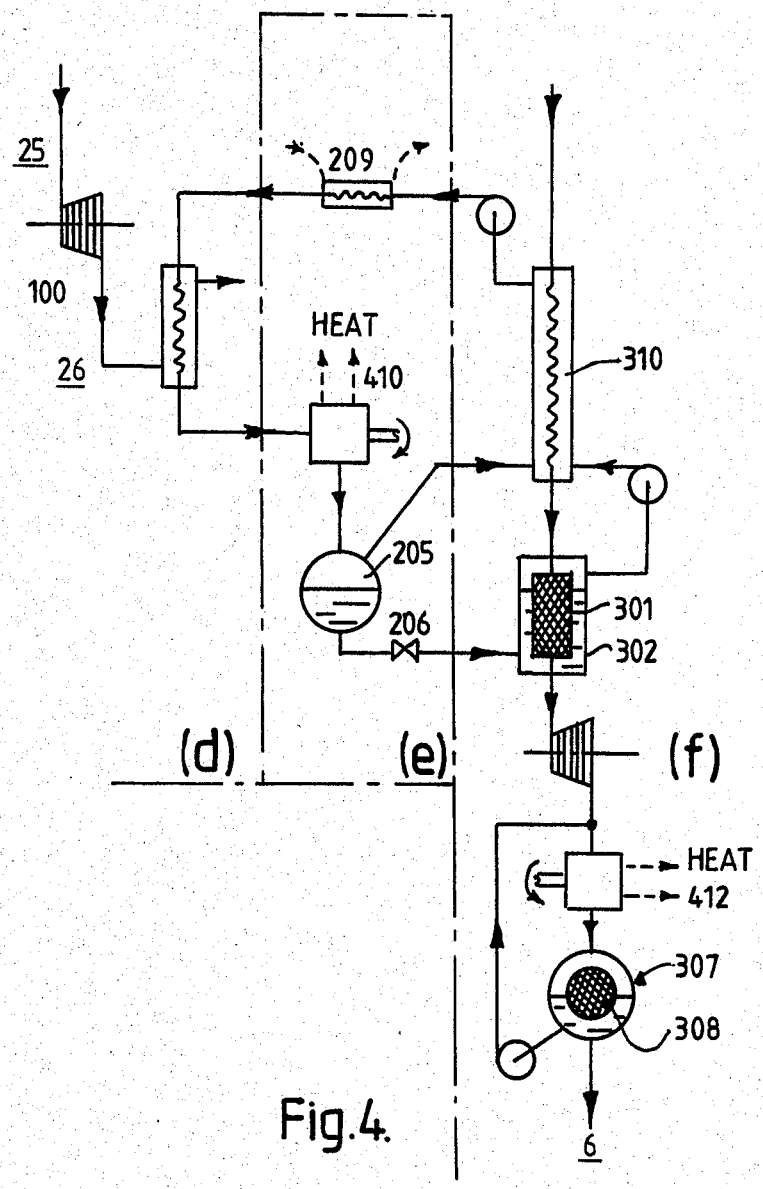
FIG. 4 illustrates the use of a reversed Stirling-cycle liquefaction machine in both the nitrogen module e and the hydrogen module f.

Various alternative plant configurations in accordance with the layout indicated in FIG. 1 are possible and nine examples are illustrated in FIGS. 2(i) through 2(iv), FIGS. 3(i) through 3(iv) and FIG. 4.

In each case the oxygen module e includes an expansion turbine 100 which may be as recommended by Swearingen J. S. (Turboexpanders and processes that use them-Chemical Engineering Progress-Vol. 68 No. 7) supplying low pressure oxygen to a heat exchanger 101 of either helical coiled tube configuration or alternatively of the so-called "plate-fin" type or indeed of any other suitable configuration connected in the nitrogen circuit of the nitrogen liquefaction module e. The oxygen passing through heat exchanger 101 is discharged to atmosphere at 27, or used as a feedstock for other purposes.

FIG. 2(i) shows a simplified liquefaction plant illustrating principal features of the invention. In the hydrogen module f the high pressure hydrogen product stream is mixed at 12 with recycled hydrogen compressed by compressors 310 and cooled in coolers 311, the mixed streams then being precooled in heat exchangers 300 and 309 nearly to liquid nitrogen temperature before being divided again at 17 prior to further cooling in sub-atmospheric pressure liquid nitrogen bath 302. The high pressure product stream passed through a catalytic converter 301 in which the hydrogen product stream passes over the catalyst and is cooled by heat exchange with boiling liquid nitrogen to convert the hydrogen stream to approximately 45% para concentration at 10, and subsequently through the block heat exchanger 304 in which the stream is cooled against the exhaust stream 2 of the hydrogen turbine 303 combined at 8 with the hydrogen stream 7 returning from the sub-atmospheric pressure liquid hydrogen tank 307. The hydrogen product stream 5 passes through expansion throttle 306 and final cooling and conversion to at least 95% para hydrogen at ambient pressure, occurs in the low-level catalytic converter 308. The hydrogen refrigeration stream cooled separately in the liquid nitrogen tank 302 from condition 17 is divided at 1, part flowing through the expansion turbine 303 to provide the said cold low pressure hydrogen at 2, and part flowing at high pressure through the block heat exchanger 304 to the expansion throttle 305 where the stream is expanded to sub-atmospheric pressure to provide cold liquid hydrogen at a temperature below that of the liquid product stream for cooling the catalytic converter 308. The sub-atmospheric pressure hydrogen stream 8 is returned in heat-exchange with the streams being cooled in block heat exchanger 304 and in heat exchanger 309, for recycling to compressors 310 and coolers 311 which may be arranged for multi-staging to minimise the work requirement. Heat exchangers 300 and 309 may be combined to form one block exchanger, if desired. Also, it will be understood that in an alternative arrangement, the conditions may be set such that the gaseous nitrogen stream 14 and hydrogen recycle stream 9 can be connected to heat exchangers 309 and 300 respectively and not as shown in FIG. 2(i).

It will be seen that catalytic conversion from ortho to para hydrogen equilibrium composition takes place in two stages: a first stage at the liquid nitrogen temperature and a second at the temperature of liquid hydrogen, so that the work required is less than for a single low temperature stage conversion, part of the heat being extracted at a higher temperature. The hydrogen module of FIG. 2(i) is a simplified version of that described by Baker and Shaner ("A study of the Efficiency of Hydrogen liquefaction," Int. J. Hydrogen Energy 1978, vol. 3 pp. 321–334).

In the nitrogen module e, high pressure nitrogen at condition 23 is cooled in heat exchanger 201 against a cold low pressure nitrogen stream 24 obtained from the expansion turbine 200 using equipment similar to that described for module d. Cold high pressure nitrogen streams 28 and 29 are combined to provide inlet stream 30 to the low level expansion turbine 202 which delivers nitrogen at atmospheric pressure and liquefaction temperature to heat exchanger 203. Heat exchanger 203 cools a high pressure stream of nitrogen from 23 to 22 which then passes through expansion throttle 204 to atmospheric pressure in storage tank 205 where the nitrogen stream is partially liquefied at 21.

To obtain a lower temperature in liquid nitrogen tank 302, atmospheric pressure liquid nitrogen from storage tank 205 is further expanded through throttle 206 to sub-atmospheric pressure at 18. Returning low pressure nitrogen vapour at 19 passes through compressor 207 and is delivered to heat exchanger 203 at one atmosphere, to mix with the nitrogen passing from 31 to 32 at a point where, desirably, the temperature corresponds to that of stream 20. Cold nitrogen vapour at one atmosphere passes from storage tank 205 to heat exchanger 300 where it exchanges heat with the hydrogen product stream, and in so doing is warmed to condition 15. Desirably nitrogen streams 15, 32 and 33 are at the same temperature, and at 34 combine to be recycled by compressors 208 and coolers 209, which may be arranged for multi-staging to minimise the work requirement.

To assist a more detailed understanding of the operation of the embodiment described above with reference to FIG. 2(i), the conditions at various stations (1 to 34) are set out in Table 1.

FIG. 2(ii) has the same oxygen module d and nitrogen module e as FIG. 2(i), but illustrates an alternative hydrogen liquefaction module in which the hydrogen turbine 303 and block heat exchanger 304 of FIG. 2(i), have been divided into upper and lower level units 303*a*, 304*a* and 303*b*, 304*b*. As described in the paper by Baker and Shaner, significant reduction in recycle compression work is obtained by expanding part of the high pressure hydrogen refrigeration stream to an intermediate pressure level in order to obtain intermediate cooling conditions, the remainder of the stream passing through expansion throttle 305 to sub-atmospheric pressure level in liquid hydrogen tank 307. Respectively high pressure, intermediate pressure and sub-atmospheric pressure levels may be around 45, 2.5 and 0.4 bar. The catalytic converter shown schematically as 315 and included in the hydrogen liquefaction module 301, 308 may incorporate a catalyst container 317 with respectively pre- and post-cooling heat exchange elements 316 and 318, as described in the papers by Newton ("Hydrogen production and liquefaction" Chem. and Process Engineering, December 1967 pp. 51–58 and "Hydrogen production, liquefaction and use" Cryogenic Engineering News, Part I August 1967 pp. 50–60, Part II, September 1967 pp. 24–31). The possibility of including such converters in block heat exchangers 304*a*, 304*b* and 312 is indicated. Low level hydrogen compressors and coolers 310*b*, 311*b* and high level hydrogen compressors and coolers 310*a*, 311*a* may be arranged for multi-staging to minimise the work requirement. In FIG. 2(ii) the hydrogen recycle refrigeration stream 319 is completely separate from the process hydrogen liquefaction stream 320 which provides flexibility in selection of the respective pressure levels. For practical design of block heat exchanger 312 it may be desirable to combine streams 319 and 320 which would then require to be at the same pressure levels in an arrangement shown in the paper by Baker and Shaner.

TABLE I

| STATION | FLUID | MASS FLOW kg/sec | PRESSURE bar | TEMP. K. | ENTHALPY kJ/kg |
|---|---|---|---|---|---|
| 1 | $GH_2$ | — | 45 | 70 | 1128.5 |
| 2 | " | 2.163 | 0.4 | 18 | 704.1 |
| 3 | " | 1.066 | 45 | 25 | 359.0 |
| 4 | " | 1.066 | 0.4 | 18 | 359.0 |

TABLE I-continued

| STATION | FLUID | MASS FLOW kg/sec | PRESSURE bar | TEMP. K. | ENTHALPY kJ/kg |
|---|---|---|---|---|---|
| 5 | $eGH_2$ | 1.0 | 45 | 25 | 141.2 |
| 6 | 0.95 $pLH_2$ | 1.0 | 1.0 | 20.3 | −221.1 |
| 7 | $GH_2$ | 1.066 | 0.4 | 18 | 704.1 |
| 8 | " | 3.230 | 0.4 | 18 | 704.1 |
| 9 | " | 3.230 | 0.4 | 65 | 1197.1 |
| 10 | $eGH_2$ | 1.0 | 45 | 70 | 912.9 |
| 11 | $GH_2$ | 3.230 | 0.4 | 290 | 4084.0 |
| 12 | " | — | 45 | 300 | 4246.2 |
| 13 | " | 3.017 | 45 | 72 | 1155.6 |
| 14 | $GN_2$ | 16.040 | 1.0 | 80 | 80.0 |
| 15 | " | 16.040 | 1.0 | 290 | 300.8 |
| 16 | $GH_2$ | 1.213 | 45 | 85 | 1326.4 |
| 17 | " | — | 45 | 75.6 | 1204.6 |
| 18 | wet $N_2$ | 2.864 | 0.2 | 66 | −120.8 |
| 19 | $GN_2$ | 2.864 | 0.2 | 66 | 66.8 |
| 20 | " | 2.864 | 1.0 | 128 | 126.5 |
| 21 | wet $N_2$ | — | 1.0 | 78 | 46.86 |
| 22 | $GN_2$ | 18.90 | 40 | 132 | 46.86 |
| 23 | " | — | 40 | 300 | 303.0 |
| 24 | " | 13.09 | 1.0 | 133 | 136.9 |
| 25 | $GO_2$ | 8.0 | 35 | 300 | 264.7 |
| 26 | " | 8.0 | 1.0 | 136 | 122.7 |
| 27 | " | 8.0 | 1.0 | 290 | 263.5 |
| 28 | $GN_2$ | 6.00 | 40 | 150 | 115.0 |
| 29 | " | 11.41 | 40 | 150 | 115.0 |
| 30 | " | 17.40 | 40 | 150 | 115.0 |
| 31 | 0.87 $GN_2$ | 17.40 | 1.0 | 78 | 51.11 |
| 32 | $GN_2$ | 20.264 | 1.0 | 290 | 300.8 |
| 33 | " | 13.09 | 1.0 | 290 | 300.8 |
| 34 | " | 49.392 | 1.0 | 290 | 300.8 |

FIG. 2(iii) has the same oxygen module d as FIG. 2(ii) but illustrates a different nitrogen module e and a different hydrogen module f. In this configuration liquid nitrogen 210 is drawn from storage tank 205 at atmospheric pressure and passes to liquid nitrogen tank 313 for heat exchange with hydrogen refrigeration stream 319 and hydrogen liquefaction stream 320. Nitrogen vapour 211 from tank 313 combines with nitrogen vapour 212 at atmospheric pressure from storage tank 205 before passing through block heat exchanger 312 and returning to the nitrogen module e at 213. This arrangement permits catalytic conversion of hydrogen at a higher temperature level than with the arrangement in FIG. 2(ii).

FIG. 2(iv) combines the arrangements of FIGS. 2(ii) and 2(iii) illustrating the use of two liquid nitrogen catalytic converters, one operating at atmospheric pressure and one below atmospheric pressure as described by Dini and Martarano ("Design of optimised large and small hydrogen liquefaction plants", Hydrogen Energy Progress, 3rd World Hydrogen Energy Conference, Vol. 4 1980 pp. 2393–242).

FIG. 3(i) shows another simplified liquefaction plant illustrating principal features of the invention. The oxygen module d and the hydrogen module f are identical with those shown in FIG. 2(i). The difference in nitrogen module e of this plant from that shown in FIG. 2(i) lies in replacement of expansion turbine 202 by wet expansion engine 214 discharging directly into liquid nitrogen storage tank 205 at atmospheric pressure. This eliminates heat exchanger 203 and expansion throttle 204 and the need for high pressure nitrogen stream 23 to 22. The one atmosphere nitrogen return stream 20 from compressor 207 is conveniently combined with the exhaust 24 of nitrogen turbine 200. To ease the required thermodynamic performance of wet expansion engine 214, the vapour return 20 from liquid nitrogen tank 302 must not be combined with the nitrogen vapour stream 14. Typical operating conditions at 1 to 34 of the plant (c.f. Table I) are set out in Table II.

FIG. 3(ii) has the same oxygen module d and nitrogen module e as FIG. 3(i), but illustrates an alternative hydrogen liquefaction module already described in discussion of FIG. 2(ii).

FIG. 3(iii) has the same oxygen module d as FIG. 3(ii) but illustrates a different nitrogen module e. The alternative hydrogen liquefaction module has already been described in discussion of FIG. 2(iii). As in FIG. 2(iii) liquid nitrogen 210 is drawn from storage tank 205 at atmospheric pressure and passes to liquid nitrogen tank 313 for heat exchange with hydrogen refrigeration stream 319 and hydrogen liquefaction stream 320, at a higher temperature level than is the case with liquid nitrogen tank 302 of FIG. 3(ii).

TABLE II

| STATION | FLUID | MASS FLOW kg/sec | PRESSURE bar | TEMP. K. | ENTHALPY kJ/kg |
|---|---|---|---|---|---|
| 1 | $GH_2$ | — | 45 | 70 | 1128.5 |
| 2 | " | 2.163 | 0.4 | 18 | 704.1 |
| 3 | " | 1.066 | 45 | 25 | 359.0 |
| 4 | " | 1.066 | 0.4 | 18 | 359.0 |
| 5 | $eGH_2$ | 1.0 | 45 | 25 | 141.2 |
| 6 | 0.95 $pLH_2$ | 1.0 | 1.0 | 20.3 | −221.1 |
| 7 | $GH_2$ | 1.066 | 0.4 | 18 | 704.1 |
| 8 | " | 3.230 | 0.4 | 18 | 704.1 |
| 9 | " | 3.230 | 0.4 | 65 | 1197.1 |
| 10 | $eGH_2$ | 1.0 | 45 | 70 | 912.9 |
| 11 | $GH_2$ | 3.230 | 0.4 | 290 | 4084.0 |
| 12 | " | — | 45 | 300 | 4246.2 |
| 13 | " | 3.017 | 45 | 72 | 1155.6 |
| 14 | $GN_2$ | 16.040 | 1.0 | 80 | 80.0 |
| 15 | " | 16.040 | 1.0 | 290 | 300.8 |
| 16 | $GH_2$ | 1.213 | 45 | 85 | 1326.4 |
| 17 | " | — | 45 | 75.6 | 1204.6 |
| 18 | wet $N_2$ | 2.864 | 0.2 | 66 | −120.8 |
| 19 | $GN_2$ | 2.864 | 0.2 | 66 | 66.8 |
| 20 | " | 2.864 | 1.0 | 128 | 126.5 |
| 21 | wet $N_2$ | — | 1.0 | 78 | 46.86 |
| 22 | n/a | | | | |
| 23 | $GN_2$ | — | 40 | 300 | 303.0 |
| 24 | " | 11.82 | 1.0 | 133 | 136.9 |
| 25 | $GO_2$ | 8.00 | 35 | 300 | 264.7 |
| 26 | " | 8.00 | 1.0 | 136 | 122.7 |
| 27 | " | 8.00 | 1.0 | 290 | 263.5 |
| 28 | $GN_2$ | 6.00 | 40 | 150 | 115.0 |
| 29 | " | 12.90 | 40 | 150 | 115.0 |
| 30 | " | 18.90 | 40 | 150 | 115.0 |
| 31 | n/a | | | | |
| 32 | n/a | | | | |
| 33 | $GN_2$ | 14.68 | 1.0 | 290 | 300.8 |
| 34 | " | 30.72 | 1.0 | 290 | 300.8 |

To ease the required thermodynamic performance of wet expansion engine 214 the vapour return 211 from liquid nitrogen tank 313 is passed to heat exchanger 215 and is not combined with nitrogen vapour stream 212. Heat exchanger 215 may be arranged as a cooling jacket for wet expansion engine 214, so producing a wetter stream 21 entering the liquid nitrogen storage tank 205. This effect may be further improved by passing the low pressure nitrogen return stream 19, through a second cooling jacket around the expansion engine 214, in which case the stream 19 is connected to compressor 207 downstream of the second cooling jacket. Also, it may be desirable to connect the nitrogen return stream 20 (at atmospheric pressure) to a midpoint of heat exchanger 201. Another way in which wetter conditions could be produced is to provide auxiliary refrigeration upstream of the turbine 100 in the oxygen stream. This could employ refrigeration media such as halogenated hydrocarbons, propylene or ethylene, similar auxiliary refrigeration may be provided in the nitrogen module e at inlet to the nitrogen turbine 200, in which case the nitrogen return stream 20 is connected to a midpoint of heat exchanger 201 as described above.

FIG. 3(iv) combines the arrangements of FIGS. 3(ii) and 3(iii).

FIG. 4 illustrates a different configuration of the modules d, e and f in which reversed Stirling-cycle liquefaction machines 410 and 412 are used in both the nitrogen module e and the hydrogen module f. These reversed Stirling-cycle machines may be as described in "A gas refrigerating machine for temperatures down to 20° K. and lower" G. Prast (Philips Technical Review. 1965, Vol. 26 No. 1, pp. 1–11).

To provide replenishment nitrogen for module e and nitrogen for pressurisation of gas bearings in the oxygen expansion turbine 100 it may be preferable to provide a separation plant as is known per se, in addition to apparatus described above.

I claim:

1. A method of producing liquid hydrogen comprising electrolysing water under pressure to generate separate streams of oxygen and hydrogen gas under pressure, removing heat from the hydrogen stream during liquefaction thereof by heat exchange with an inert medium flowing in a separate closed cycle buffer cooling circuit, and expanding the oxygen stream in an expansion means to produce cooling for the inert medium buffer cooling circuit, passing an inert medium liquefaction stream through wet expansion means to liquefy some of the inert medium, cooling the hydrogen product stream in a first heat exchange stage against the gaseous output of the wet expansion means and in a second heat exchange stage against the liquefied inert medium and cooling at least a part of the inert medium liquefaction stream flowing to the wet expansion means against a return flow of inert medium from the second heat exchange stage.

2. A method according to claim 1 wherein following cooling against the inert medium, the hydrogen product stream is cooled further against liquified and/or gaseous hydrogen tapped from the product stream in an open cycle hydrogen refrigeration system.

3. A method according to claim 1 wherein following cooling against the inert medium, the hydrogen is cooled further against the refrigerant in a closed cycle refrigeration circuit, the refrigerant being selected from hydrogen and helium.

4. A method according to claim 2 wherein the said further cooling is effected in stages and wherein the refrigerant stream is expanded between the said stages.

5. A method according to claim 1 wherein during liquefaction of the hydrogen product stream, the stream is at least partially converted to para- hydrogen by passing the stream through at least one high temperature level catalytic converter and at least one low temperature level catalytic converter.

6. A method according to claim 1 wherein a part of the inert medium liquefaction stream is cooled against the said return flow, in parallel with heat exchange between the remainder of the inert medium liquefaction stream and the low pressure oxygen stream.

7. Apparatus for the production of liquid hydrogen in which, during liquefaction of the hydrogen product stream, heat is removed therefrom by heat exchange with an inert medium, comprising apparatus for the electrolysis of water under pressure to produce the hydrogen product stream and an oxygen stream both under pressure, a hydrogen liquefaction module receiving a stream of hydrogen under pressure from the electrolysis means, an oxygen module receiving a stream of oxygen under pressure from the electrolysis means and including an expansion means connected to the oxygen stream for supplying low temperature and low pressure oxygen to a heat exchanger in a buffer cooling circuit connected between the hydrogen liquefaction module and the oxygen module and comprising a closed circuit refrigeration system for an inert medium including a heat exchanger in which the inert medium is cooled against low pressure oxygen received from the expansion means, wherein the hydrogen liquefaction module includes first and second heat exchangers in which the hydrogen product stream is cooled against the inert medium and the buffer cooling circuit comprises wet expansion means for liquefying part of an inert medium liquefaction stream, and connected to supply the first heat exchanger with gaseous inert medium from the wet expansion means and to supply the second heat exchanger, downstream of the first heat exchanger in the hydrogen liquefaction module, with liquefied inert medium, a return flow of inert medium from the second heat exchanger being connected to flow through a third heat exchanger supplying the wet expansion means so as to cool at least a part of the inert medium liquefaction stream against the said return flow.

8. Apparatus according to claim 7 wherein downstream of the connection between the buffer cooling circuit and the hydrogen liquefaction module, the hydrogen liquefaction module comprises further cooling means for the hydrogen product stream.

9. Apparatus according to claim 8 wherein the said further cooling means comprises at least one refrigeration stage connected for cooling the hydrogen product stream against a refrigerant.

10. Apparatus according to claim 9 wherein the refrigeration stage is connected in an open cycle refrigeration system in which the refrigerant is hydrogen tapped from the product stream.

11. Apparatus according to claim 9 wherein the refrigeration stage is connected in a closed cycle refrigeration system; the refrigerant being selected from helium and hydrogen.

12. Apparatus according to claim 8 wherein the said further cooling is effected by a plurality of refrigeration stages and comprising an expansion device connected between successive stages for expanding the refrigerant flowing therebetween.

13. Apparatus according to claim 9 wherein at least a final refrigeration stage comprises a catalytic converter.

14. Apparatus according to claim 7 wherein the buffer cooling circuit comprises compression means receiving gaseous inert medium from the said first heat exchanger, the return flow of inert medium from second heat exchanger being connected to flow to the compressor via a third heat exchanger, connected in the inert medium liquefaction means for cooling at least some of the inert medium liquefaction stream against the said return flow.

15. Apparatus according to claim 14 wherein the low pressure oxygen/inert medium heat exchanger, is connected in parallel with the third heat exchanger and cools the remainder of the inert medium liquefaction stream.

16. Apparatus according to claim 14 and comprising a fourth heat exchanger connected between the said second and third heat exchangers to receive the return flow of inert medium from the second heat exchanger for heat exchange against the inert medium liquefaction stream.

17. Apparatus according to claim 16 wherein the fourth heat exchanger is in the form of a cooling jacket around the wet expansion means.

* * * * *